US009425030B2

(12) United States Patent
DeFazio

(10) Patent No.: US 9,425,030 B2
(45) Date of Patent: Aug. 23, 2016

(54) ELECTROSTATIC SUPPRESSION OF ION FEEDBACK IN A MICROCHANNEL PLATE PHOTOMULTIPLIER

(71) Applicant: Burle Technologies, Inc., Wilmington, DE (US)

(72) Inventor: Jeffrey DeFazio, Downingtown, PA (US)

(73) Assignee: Burle Technologies, Inc., Wilmington, DE (US)

( * ) Notice: Subject to any disclaimer, the term of this patent is extended or adjusted under 35 U.S.C. 154(b) by 216 days.

(21) Appl. No.: 14/296,577

(22) Filed: Jun. 5, 2014

(65) Prior Publication Data

US 2014/0361683 A1 Dec. 11, 2014

Related U.S. Application Data

(60) Provisional application No. 61/831,808, filed on Jun. 6, 2013.

(51) Int. Cl.

| | |
|---|---|
| ***H01J 43/24*** | (2006.01) |
| ***H01J 43/14*** | (2006.01) |
| ***H01J 43/04*** | (2006.01) |

(52) U.S. Cl.

CPC ..... *H01J 43/04* (2013.01); *H01J 43/246* (2013.01)

(58) Field of Classification Search

CPC ..... H01J 43/04; H01J 43/246
USPC ..... 315/12.1; 313/532, 528, 536, 533, 313/103 R, 105 CM; 250/207
See application file for complete search history.

(56) References Cited

U.S. PATENT DOCUMENTS

| | | | | |
|---|---|---|---|---|
| 3,374,380 | A | 3/1968 | Goodrich | |
| 4,978,885 | A | 12/1990 | White et al. | |
| 5,378,960 | A | 1/1995 | Tasker et al. | |
| 5,493,111 | A * | 2/1996 | Wheeler | H01J 5/46 250/207 |
| 5,686,721 | A * | 11/1997 | Schmidt-Bocking | H01J 31/49 250/214 VT |
| 6,049,168 | A | 4/2000 | Iosue et al. | |
| 6,538,399 | B1 | 3/2003 | Shimoi et al. | |
| 7,557,503 | B2 | 7/2009 | Inagaki et al. | |
| 7,855,493 | B2 | 12/2010 | Sullivan et al. | |
| 2007/0051879 | A1 | 3/2007 | Kuzniz et al. | |

(Continued)

OTHER PUBLICATIONS

T. Jinno et al., "Lifetime-Extended MCP-PMT", Nuclear Instruments and Methods A, Oct. 7, 2010, pp. 1-14 (pre-print).

(Continued)

*Primary Examiner* — Daniel D Chang
(74) *Attorney, Agent, or Firm* — Dann, Dorfman, Herrell and Skillman, P.C.

(57) ABSTRACT

A photomultiplier tube having an ion suppression electrode positioned between a photocathode and an electron multiplying device in the photomultiplier tube is disclosed. The ion suppression electrode includes a grid that is configured to provide sufficient rigidity to avoid deformation during operation of the photomultiplier tube. The photomultiplier tube also includes a source of electric potential connected to the electron multiplying device and to the ion suppression electrode to provide a first voltage to the second electrode and a second voltage to the suppression grid electrode wherein the second voltage has a magnitude equal to or greater than the magnitude of the first voltage. A method of making the photomultiplier and a method of using it are also disclosed.

15 Claims, 14 Drawing Sheets

(56) References Cited

U.S. PATENT DOCUMENTS

2007/0263223 A1* 11/2007 Hirai ..... H01J 37/244 356/450

2010/0066245 A1 3/2010 Van Spijker

OTHER PUBLICATIONS http://www.arradiance.com/Index_Files/Technology.htm, Arradiance Inc., viewed Oct. 22, 2012.

Burle Technical Data Sheet, Planacon Photomultiplier Tube Assembly 85001-501, Oct. 2003.

Burle Technical Data Sheet, Planacon Photomultiplier Tube Assembly 85011-501, Oct. 2003.

Photonis Technical Data Sheet, Photon Detector, XP85112 Planacon, Sep. 2012.

J.L. Wiza, "Microchannel Plate Detectors", Nuclear Instruments and Methods, vol. 162, 1979, pp. 587-602.

N. Kishimoto et al., "Lifetime of MCP-PMT", Nuclear Instruments and Methods in Physics Research Section A: Accelerators, Spectrometers, Detectors and Associated Equipment, Aug. 1, 2006, Abstract only.

* cited by examiner

ELECTROSTATIC SUPPRESSION OF ION FEEDBACK IN A MICROCHANNEL PLATE PHOTOMULTIPLIER

CROSS-REFERENCE TO RELATED APPLICATIONS

This application claims the benefit of U.S. Provisional Application No. 61/831,808, filed Jun. 6, 2013, the entirety of which is incorporated herein by reference.

BACKGROUND OF THE INVENTION

1. Field of the Invention

This invention relates to photomultiplier tubes and in particular, to a microchannel plate photomultiplier tube that provides suppression of ions generated throughout the microchannel plate when the photomultiplier tube is in operation.

2. Description of the Related Art

During operation of a transmission-mode microchannel plate photomultiplier tube (MCP-PMT) positive ions are generated along the length of the MCP pores and are accelerated directly towards the photocathode, where they impact with significant energy. This phenomenon is termed "ion feedback" and is responsible to a significant degree for degradation of photocathode sensitivity and adversely affects the expected lifetime of the device. There are known techniques directed at reducing or eliminating the ion feedback effect that generally involve reducing the number of ions through the use of sophisticated materials engineering and/or vacuum processing. Alternatively, physical ion barriers formed in the MCP geometry and/or ion barrier films deposited on an external surface of the MCP have been used.

In a transmission-mode MCP-PMT, photons are detected by their absorption and the subsequent ejection of photoelectrons from a semi-transparent photocathode deposited on the vacuum side of a window. The photoelectrons are amplified by a factor of at least $10^3$ by means of a secondary-electron cascade in one or more MCP's. The electrons emitted by the MCP are collected as charge pulses on a single or multi-segment anode. The operational principle of a PMT having a single MCP is illustrated in FIG. 1. An MCP-based image intensifier tube operates according to the same principle as the MCP-PMT, but the charge collecting anode is replaced by an imaging system.

MCP's are wafers containing millions of high aspect-ratio hollow channels, the walls of which have been treated to provide a desired electrical conductivity and a high probability of releasing secondary electrons. Generally, MCP's are made using leaded-glass, although the use of conformal thin-film coatings has more recently enabled MCP's to be fabricated using other substrate materials.

When an energetic primary particle such as a photoelectron strikes the wall of an MCP pore channel, it can release one or more secondary electrons. In MCP-PMTs this initial event is facilitated by (i) accelerating the photoelectron across a potential difference of at least 100 V and (ii) orienting the MCP pores at an angle relative to the wafer normal direction. The secondary electrons are accelerated down the length of the pore channel by a large electric field (~$10^6$ V/m) until they strike the channel wall and liberate additional secondary electrons. This cascade process is repeated numerous times as illustrated in FIG. 2 and results in a pulse comprising at least 1000 electrons leaving the output side of the MCP. The output electrons are then accelerated to the charge collecting anode.

Throughout the amplification process positive ions are also generated by electron-molecule collisions. Given the ultrahigh vacuum (UHV) conditions inside the MCP-PMT, direct ionization of residual gases is relatively unimportant and the ion generation occurs predominately by electron stimulated desorption (ESD) from the surfaces of the MCP pore channels. Inside the MCP pores the electric field is axial, so the ions generated can be accelerated out of the MCP back toward and into the photocathode where they adversely affect the lifetime of the device. For a typical MCP the ion yield increases exponentially along the length of the MCP pores in direct correlation with the electron density and as a result, there is an increasing distribution of higher energy ions originating nearer the output side of the MCP as illustrated in FIG. 3. If one neglects the relatively small internal energies from the ESD process, the high-energy cutoff of this distribution occurs at the full potential energy difference between the MCP output and the photocathode which is typically greater than 1000 eV.

A common method of minimizing ion feedback is to treat the MCP surfaces such that fewer ions are created during the multiplication process. At a minimum this is done through the use of UHV techniques involving extreme cleanliness in the handling and processing environments and extended bake-outs of the MCP at elevated temperature. Additionally, extensive operation of MCP's under UHV conditions before their assembly into the PMT allows the ESD process to "scrub" the MCP surfaces which also decreases the ion feedback rate. In addition, techniques that involve either conformally depositing on the MCP a film with desirable properties to minimize damaging ion feedback or functionalizing the MCP entirely through the use of conformal coatings of desired materials have been demonstrated in the art.

Complementing the ion-minimizing methods, one solution is to physically interrupt the ions while they are in transit towards the photocathode. Certain devices such as Gen III image intensifiers make use of a thin barrier film deposited over the input of the MCP that can ensure that energetic ions cannot reach the photocathode. However, that technique is not without drawbacks in complexity and in certain aspects of performance. Another physical-barrier technique is to arrange multiple MCPs in series with their pore channel directions staggered, such that the majority of ions are guaranteed to collide with the MCP channel surfaces. The most common configurations are termed "chevron" and "Z-stack" when using two or three plates, respectively. A chevron arrangement of MCPs is shown in FIG. 4A and a Z-stack configuration is shown in FIG. 4B. In these staggered configurations the majority of ions generated deep in the MCP pores are forced to strike the upper plate where the channel wall changes their direction and the number of ions reaching the photocathode is greatly reduced although not entirely eliminated.

The PLANACON photon detector is a square-shaped, multi-anode MCP-PMT that is manufactured and sold by PHOTONIS USA Pennsylvania Inc., of Lancaster, Pa. The PLANACON photon detector is used for many photon detection applications where large detection areas are required. The unique format of the PLANACON detector makes it the largest detector areally of its type on the market and allows for many PLANACON detector units to be tiled together in order to form a larger image.

SUMMARY OF THE INVENTION

The problems associated with ion feedback in an MCP-PMT are solved to a large degree by a photomultiplier tube in accordance with the present invention. In accordance with one aspect of the present invention there is provided a photomultiplier tube that includes a photocathode having a first surface for receiving light and a second surface opposite the first surface from which electrons are emitted in response to light that is incident on the first surface. The photomultiplier also includes an electron multiplying device positioned in spaced relation to the photocathode. The electron multiplying device has an electron receiving side that faces the second surface of the photocathode and an electron emission side opposite the electron receiving side. The electron multiplying device is positioned such that the electron receiving side is located at a preselected distance from the second surface of the photocathode. A first electrode is operatively connected to the electron receiving side of the electron multiplying device. A second electrode is operatively connected to the electron emission side of the electron multiplying device. An ion suppression electrode is positioned between the photocathode and the electron multiplying device and spaced therefrom. The ion suppression electrode preferably includes a conductive grid. The photomultiplier according to the present invention further includes a source of electric potential connected to the second electrode and to the ion suppression electrode. The electric potential source is configured and adapted to provide a first voltage to the second electrode and a second voltage to the suppression grid electrode wherein the second voltage has a magnitude equal to or greater than the magnitude of the first voltage.

In accordance with another aspect of the present invention there is described a method of making a photomultiplier that provides suppression of ions. The method includes the steps of providing a photocathode having a first surface for receiving light and a second surface opposite the first surface from which electrons are emitted in response to light that is incident on the first surface and providing an electron multiplying device in spaced relation from the photocathode, wherein the electron multiplying device has an electron receiving side that faces the second surface of the photocathode and an electron emission side opposing the electron receiving side. The electron multiplying device is positioned such that the electron receiving side is located at a preselected distance from the second surface of said photocathode. The method according to this invention also includes the steps of providing an ion suppression electrode between the photocathode and the electron multiplying device. Preferably, the ion suppression electrode is formed as a grid. Further steps of the method include energizing the electron receiving surface of the electron multiplying device with a first voltage, energizing the electron emission surface of the electron multiplying device with a second voltage that is greater in magnitude than the first voltage, and energizing the suppression electrode with a third voltage having a magnitude that is equal to or greater than the magnitude of the second voltage.

In accordance with a further aspect of the present invention, there is disclosed a method of suppressing feedback ions in the photomultiplier described above.

BRIEF DESCRIPTION OF THE DRAWINGS

The foregoing summary as well as the following detailed description will be better understood when read with reference to the several views of the drawing, wherein.

DETAILED DESCRIPTION

Figure 6:
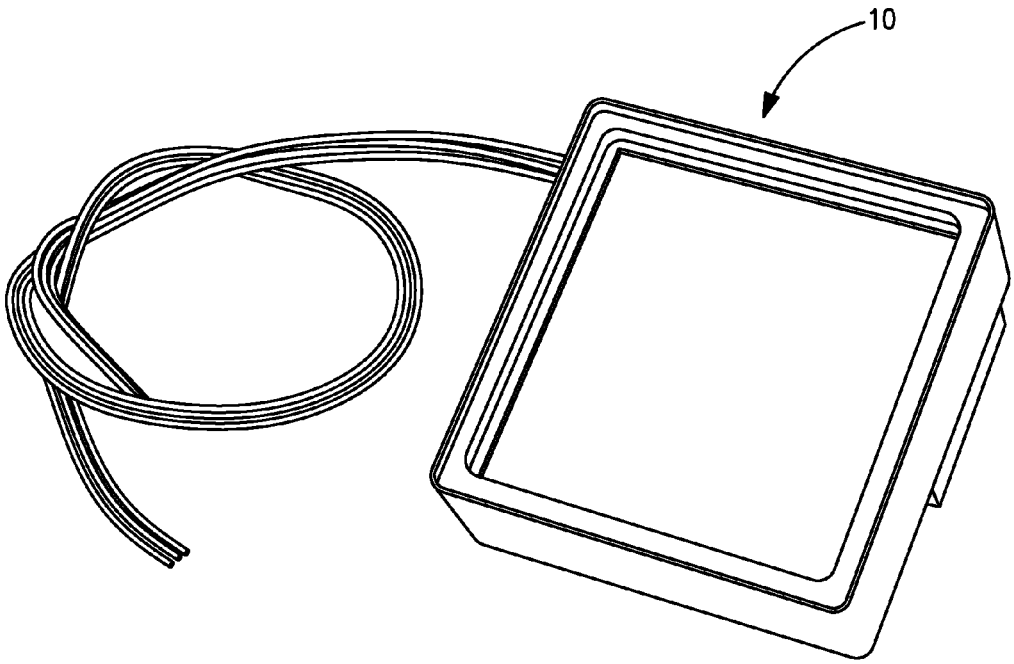
FIG. 6 is a perspective view of a photomultiplier in accordance with the present invention.
Figure 7:
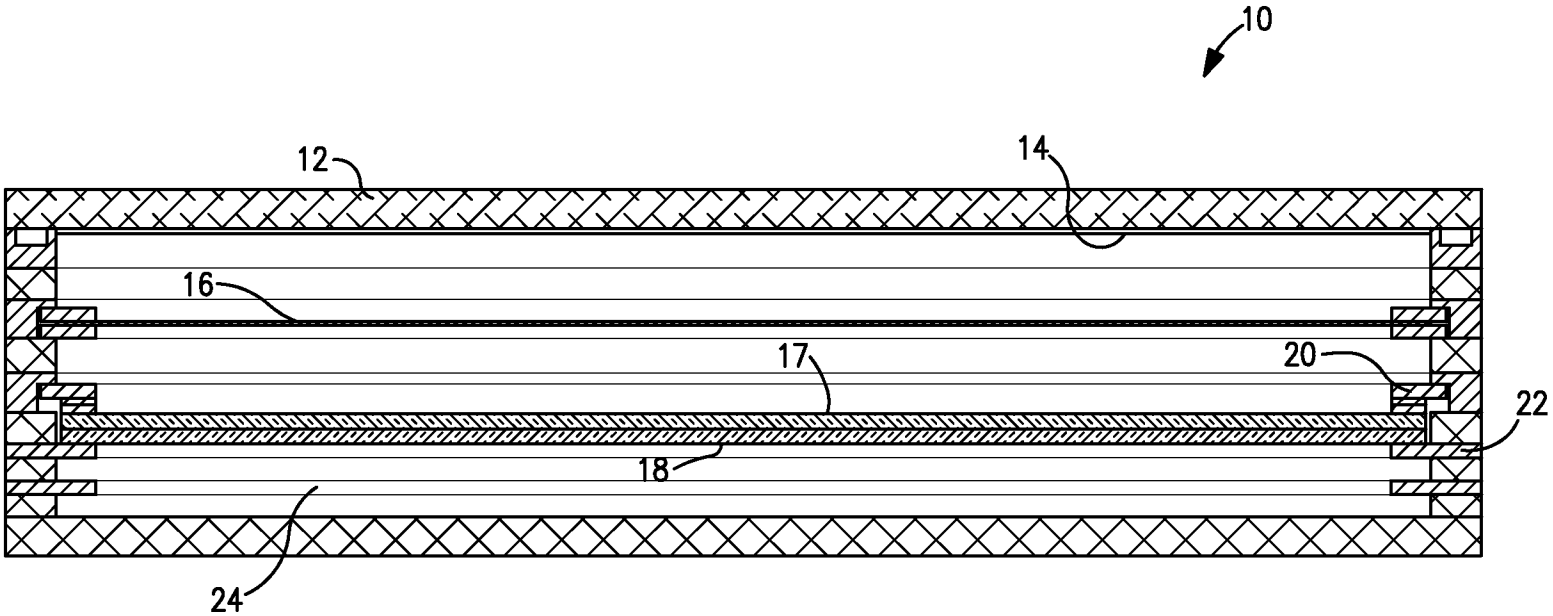
FIG. 7 is cross-sectional view of the photomultiplier of FIG. 6.

Referring now to the drawings and in particular to FIGS. 6 and 7, there is shown a photomultiplier tube in accordance with the present invention. The photomultiplier tube 10 includes a housing in which the internal components of the device are sealed so that a vacuum can be maintained inside the photomultiplier tube 10. The photomultiplier tube 10 preferably has a high useful area ratio (open area ratio) and a footprint having one or more flat sides so that the photomultiplier tube can be butted up against one or more similar units. Such an arrangement provides a wide imaging area and permits tiling of multiple units to provide a wide variety of imaging areas and geometries.

Referring now to FIG. 7, the photomultiplier tube 10 includes an input window 12 for receiving light. The window 12 is formed of a light transmitting material such as a glass or transparent crystal. Preferred materials for the window of a photomultiplier tube are known to those skilled in the art. A photocathode 14 is positioned internally to the photomultiplier tube 10 adjacent the window 12. Preferably the photocathode is formed as a thin layer on the inside surface of the window. An electron multiplying device is positioned inside the photomultiplier tube 10 in spaced relation to the photocathode 14. In the embodiment shown in FIG. 7, the electron multiplying device includes a first microchannel plate 17 and a second microchannel plate 18. The first and second microchannel plates 17 and 18 are stacked on each other such that their respective pore channels are oriented at an angle to each other so as to provide the known chevron configuration. In a different embodiment there may be three or more microchannel plates stacked vertically with their respective pore channels oriented at angles to each other so as to provide the known z-stack configuration. It is also contemplated that the electron multiplying device may consist of a single microchannel plate.

A first contact or electrode 20 is connected to the input surface of first microchannel plate 17. A second contact or electrode 22 is connected to the output surface of second microchannel plate 18. Suitable leads or other terminals are connected to the first and second electrodes so that the electrodes can be connected to a source of electric voltage. A charge collecting anode 24 is positioned between the microchannel plate 18 and the base of the photomultiplier tube 10. The anode 24 may consist of a single electrode or multiple electrodes depending on the application in which the photomultiplier will be used. A suitable lead or leads are connected to the anode so that it can be connected to a signal analyzing instrument that converts the collected charges into signal that can be used to generate and/or display useful information.

In addition to the foregoing features, the photomultiplier tube 10 has an ion suppression electrode 16 that is positioned between the photocathode 14 and the first microchannel plate 17. The ion suppression electrode 16 includes a grid that is preferably formed of a material and in a configuration that results in sufficient rigidity that the electrode 16 maintains a substantially planar form. The ability to maintain a planar form is important because of the relatively wide viewing/imaging area that the electrode 16 covers. Too much sagging of the electrode 16 will adversely affect performance of the device and in extreme cases could result in a catastrophic short circuit when the device is in operation.

Figure 8:
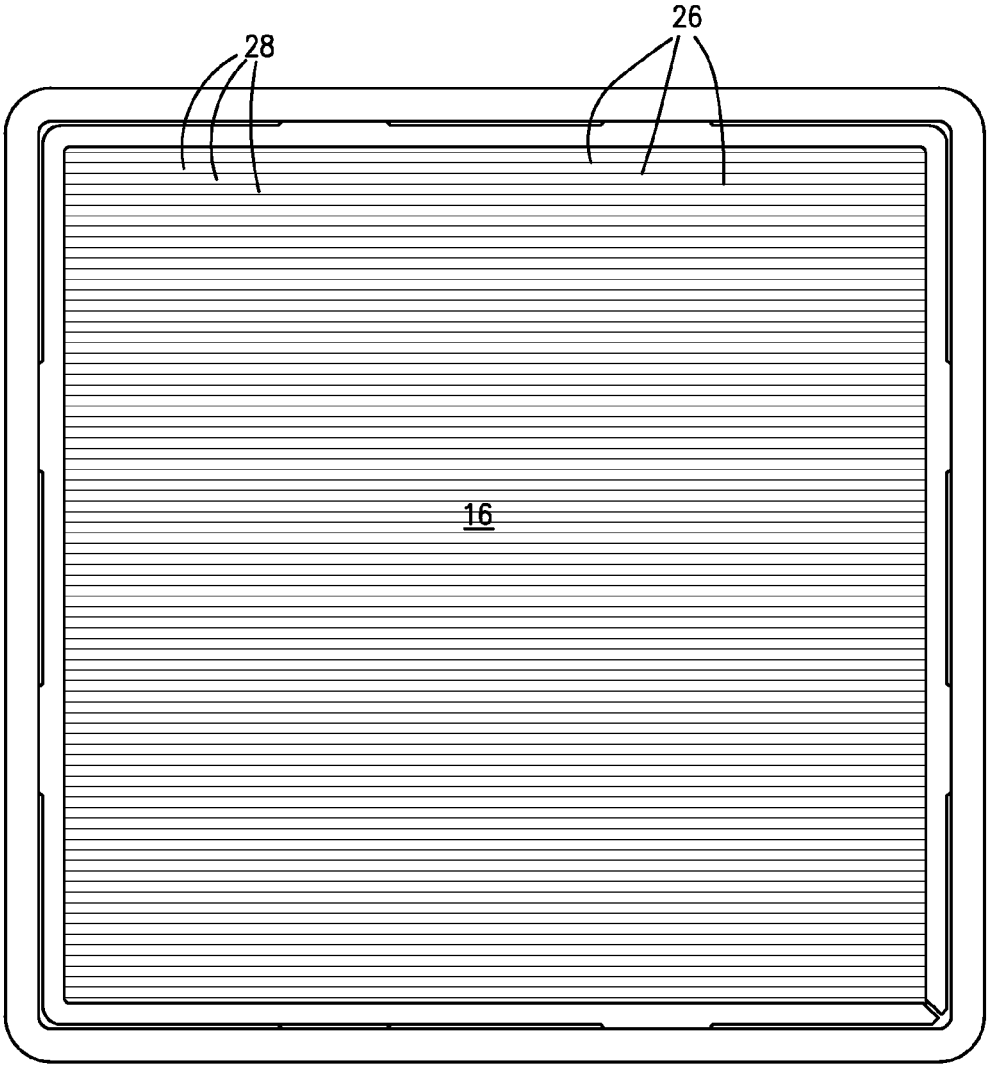
FIG. 8 is a plan view of a first embodiment of an ion suppression grid used in the photomultiplier of FIGS. 6 and 7.

Referring now to FIG. 8, there is shown a first embodiment of the grid for ion suppression electrode 16 according to the present invention. The electrode 16 preferably includes a grid formed of metallic elements 26 that are spaced from each other to provide small openings 28 that are dimensioned to permit electrons to pass. Moreover, each opening 28 is dimensioned to be small enough to minimize or substantially eliminate a potential (voltage) gradient between the metallic elements that define the opening. In a preferred embodiment, the opening is dimensioned to be not greater than about one-tenth of the distance between the photocathode and the input side of the electron multiplying device.

Figure 9:
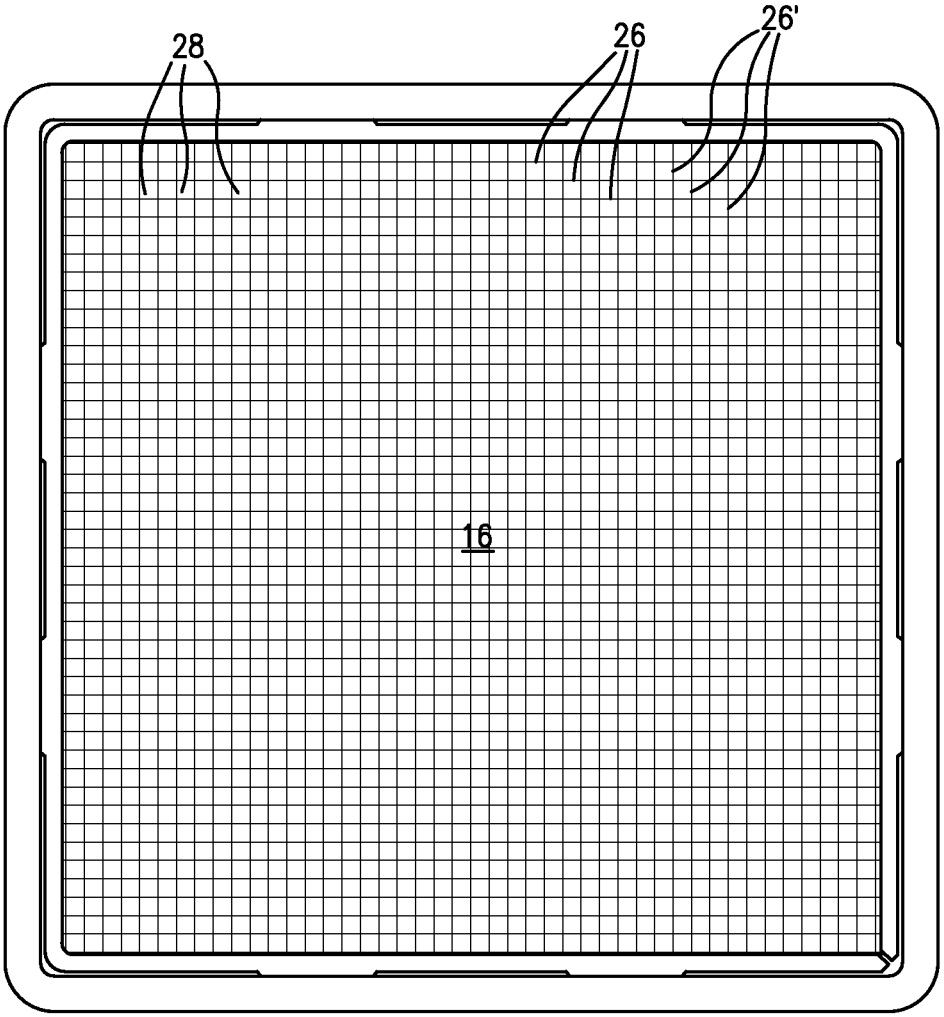
FIG. 9 is a plan view of a second embodiment of an ion suppression grid used in the photomultiplier of FIGS. 6 and 7.
Figure 10:
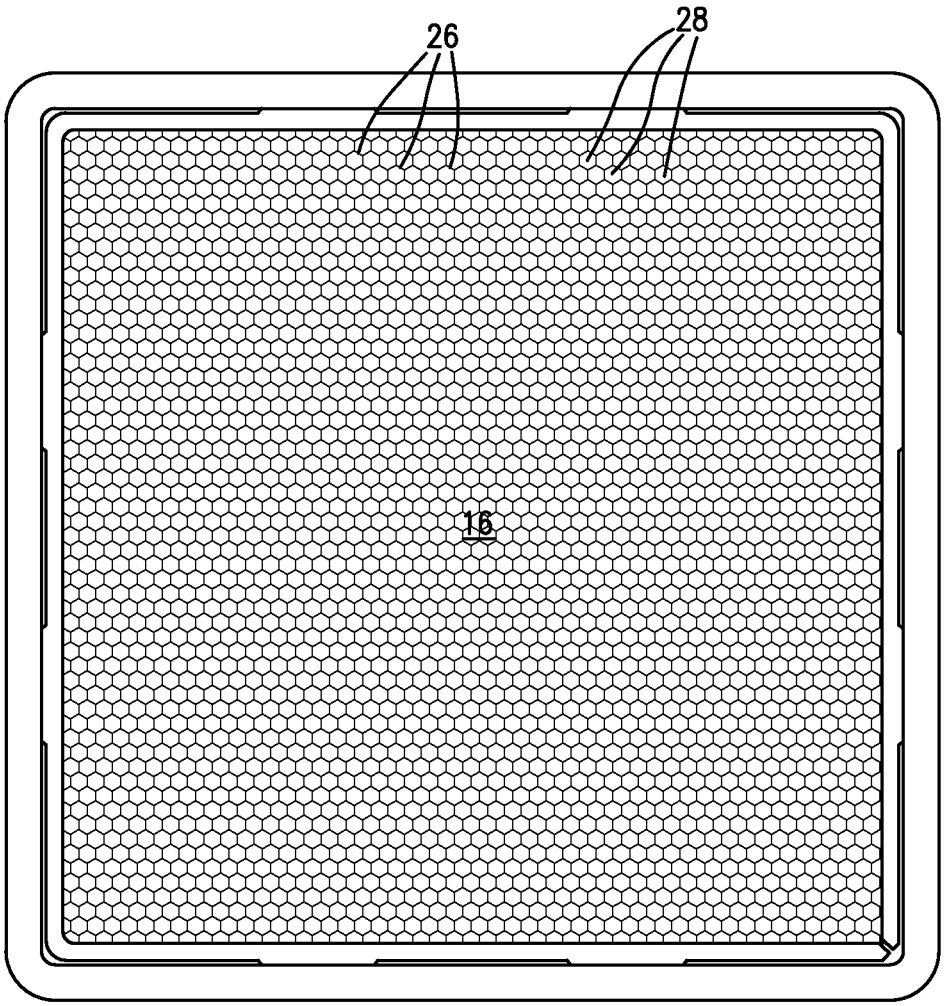
FIG. 10 is a plan view of a third embodiment of an ion suppression grid used in the photomultiplier of FIGS. 6 and 7.
Figure 11:
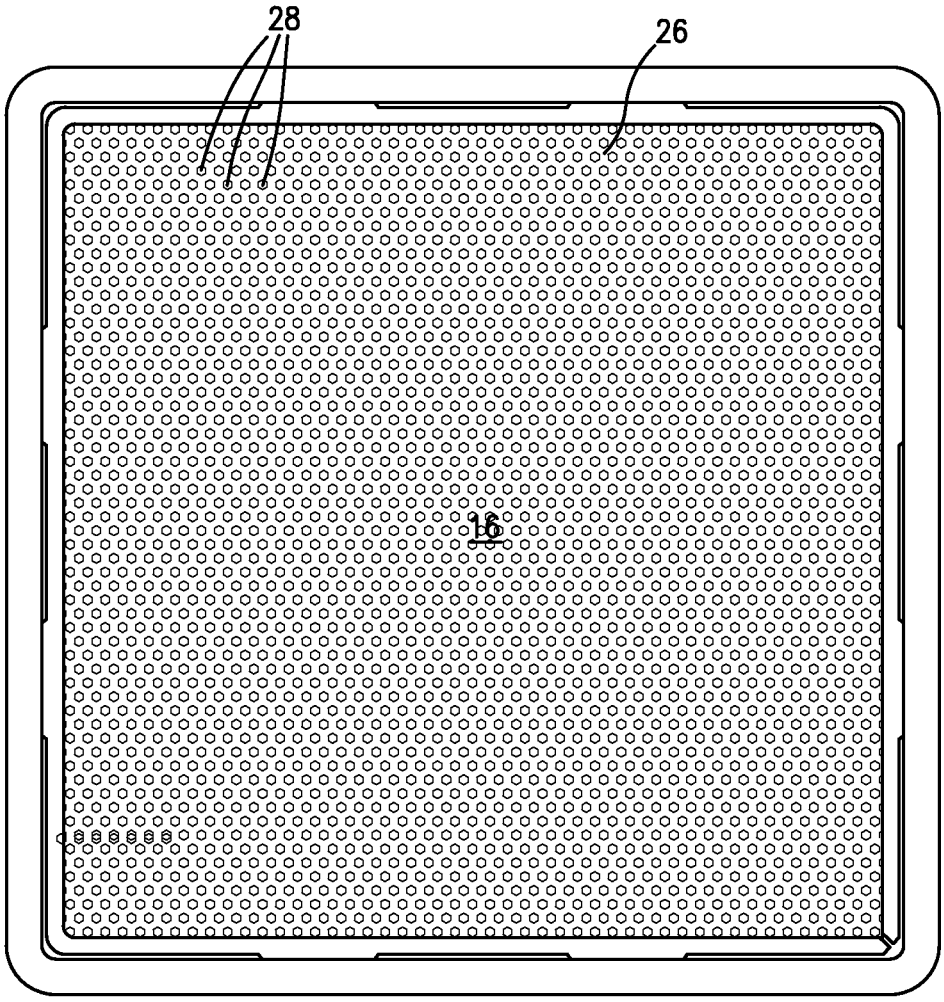
FIG. 11 is a plan view of a fourth embodiment of an ion suppression grid used in the photomultiplier of FIGS. 6 and 7.

In the embodiment of FIG. 8, the metallic elements 26 are realized as fine wires that are equi-spaced and aligned in parallel. The openings 28 have an elongated geometry. In the embodiment shown in FIG. 9, the grid has a first set of metallic elements 26 arranged as in FIG. 8 and a second set of metallic elements 26' that are equi-spaced and oriented transversely to the first set of metallic elements 26. In the embodiment shown in FIG. 9, the openings 28 have a square geometry. In FIG. 10, the electrode 16 has a grid that includes a plurality of metallic elements 26 that are constructed and arranged with hexagonal geometries. FIG. 11 shows an electrode grid 16 that is formed from thin plate or foil which functions as the metallic elements. The openings 28 are typically formed in the thin plate or foil using photochemical etching or any other known microfabrication technique.

Figure 12:
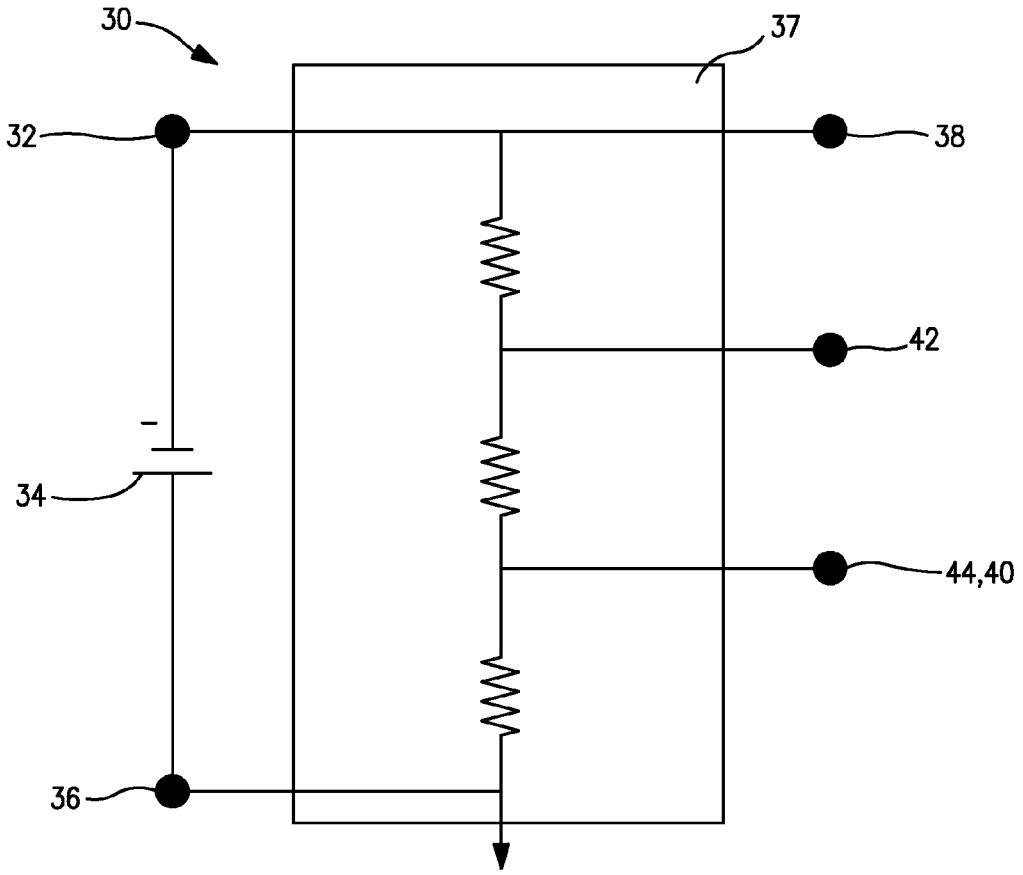
FIG. 12 is a schematic diagram of a first embodiment of an electric potential source used with the photomultiplier according to the present invention.
Figure 13:
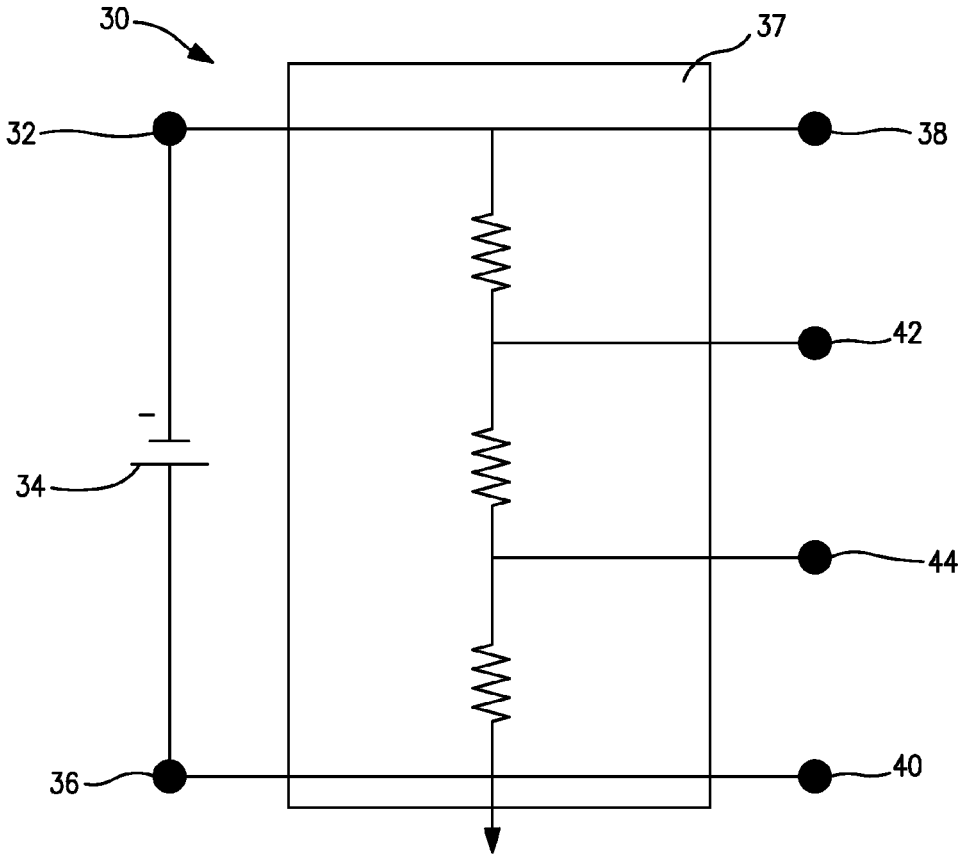
FIG. 13 is a schematic diagram of a second embodiment of the electric potential source used with the photomultiplier according to the present invention.

Referring to FIG. 12, there is shown a first embodiment of an electric potential source 30 to which the photomultiplier tube of this invention is connected for operation. The electric potential source 30 includes a first terminal 32 that is connected to the output terminal of a dc voltage supply 34. A second terminal 36 is connected to ground potential or to a reference terminal of the dc voltage supply. The electric potential source 30 includes a voltage divider network 37 having a first terminal 38 that is connected to the photocathode 14 for applying a first electric potential to the photocathode. The electric potential source 30 has second terminal 40 that is connected to the ion suppression electrode 16 for applying a second electric potential thereto. Potential source 30 further includes third and fourth terminals 42, 44 that are connected respectively to the input and output electrodes 20, 22 of the electron multiplying device for applying third and fourth electric potentials thereto. In the embodiment shown in FIG. 12, the voltage divider network 37 is constructed and arranged such that when it is energized by the dc voltage supply 34, the electric potential provided at the second terminal 40 has a magnitude that is equal to the electric potential provided at the fourth terminal 44 in order to suppress positive ion feedback from the electron multiplier. In the embodiment shown in FIG. 13, the voltage divider network 37 is constructed and arranged such that when it is energized by the dc voltage supply 34, the electric potential provided at the second terminal 40 has a magnitude that is greater than the electric potential provided at the fourth terminal 44 in order to suppress positive ion feedback from the electron multiplier to a greater degree than with the embodiment of FIG. 12.

Figure 14:
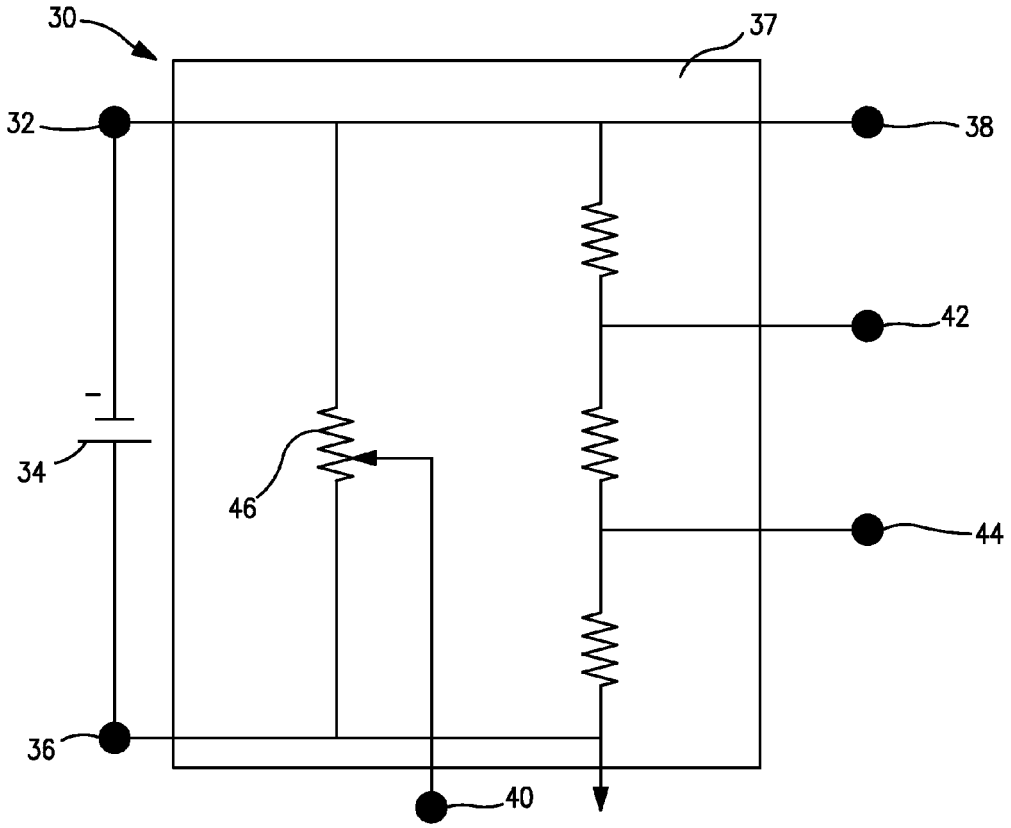
FIG. 14 is a schematic diagram of a third embodiment of the electric potential source used with the photomultiplier according to the present invention.

It is also contemplated that the electric potential source 30 may include means for varying the magnitude of the voltage applied to the suppression electrode. Referring to FIG. 14 there is shown a further embodiment of electric potential source 30 that provides such functionality. As shown in FIG. 14, the voltage divider network includes a variable resistor 46 connected between the first terminal 32 and the second terminal 40. By adjusting variable resistor 46, the electric potential at second terminal 40 is varied. Since the ion suppression electrode is connected to second terminal 40, the potential of the ion suppression electrode is also varied. In this manner, the degree of ion suppression can be adjusted depending upon the application in which the photomultiplier tube is used.

Figure 1:
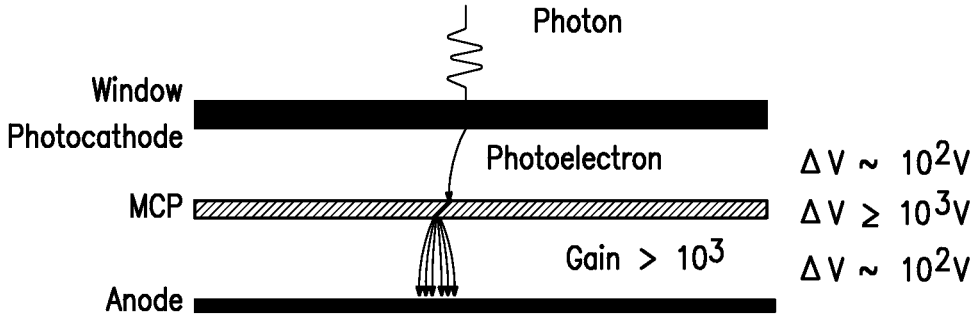
FIG. 1 (PRIOR ART)
FIG. 1 is a schematic diagram showing the operation of a known photomultiplier tube.
Figure 2:
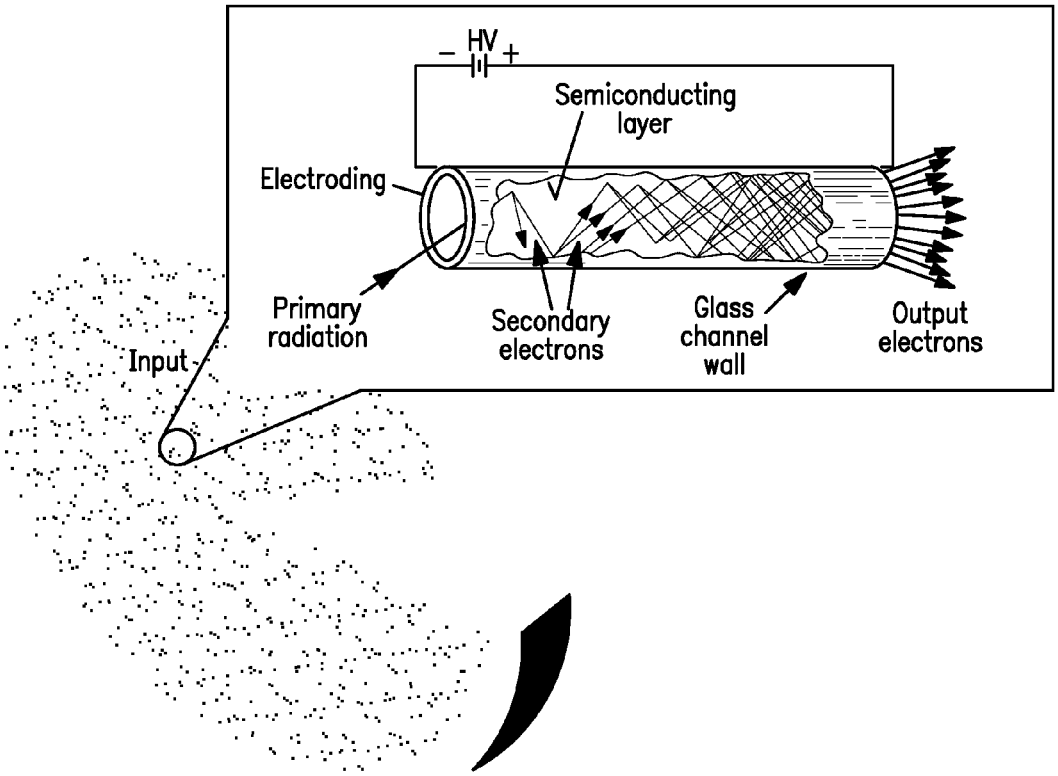
FIG. 2 (PRIOR ART)
FIG. 2 is a schematic diagram of a known microchannel plate and its principle of operation.
Figure 3:
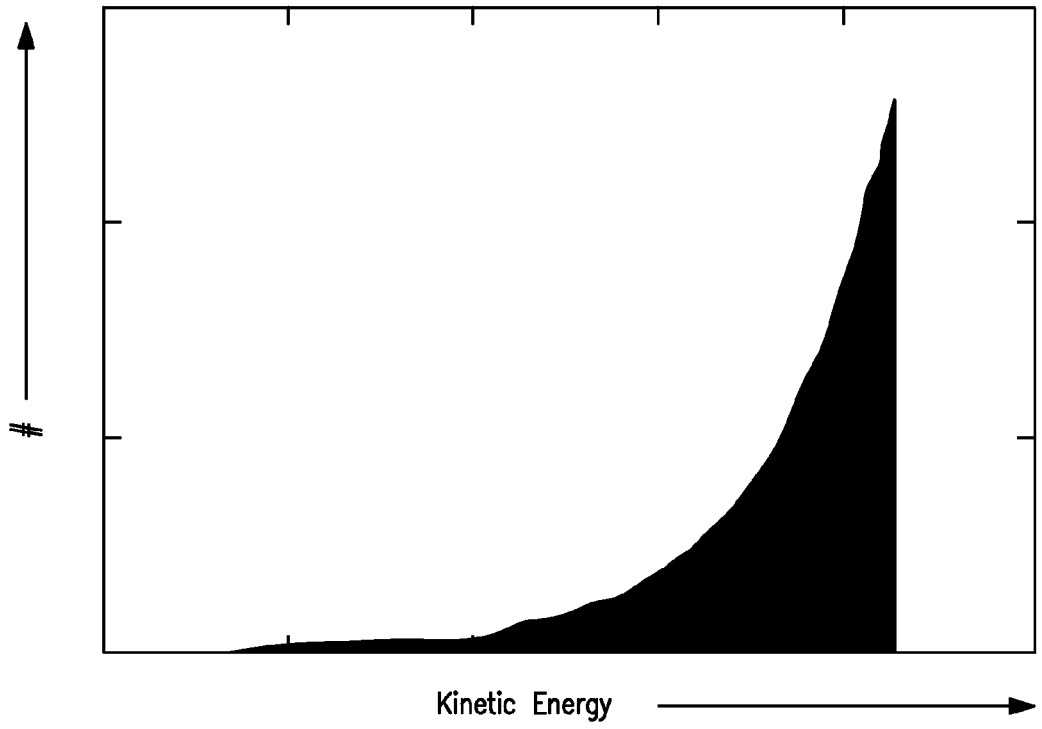
FIG. 3 is a graph of ion yield as a function of energy as formed along the length of a pore channel in a known microchannel plate.
Figure 4A:
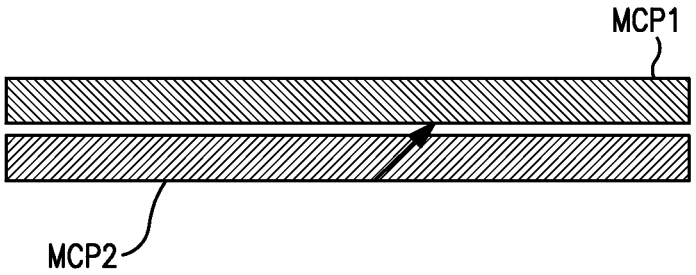
FIG. 4A (PRIOR ART)
FIG. 4A is a schematic view of two microchannel plates in the known chevron configuration.
Figure 4B:
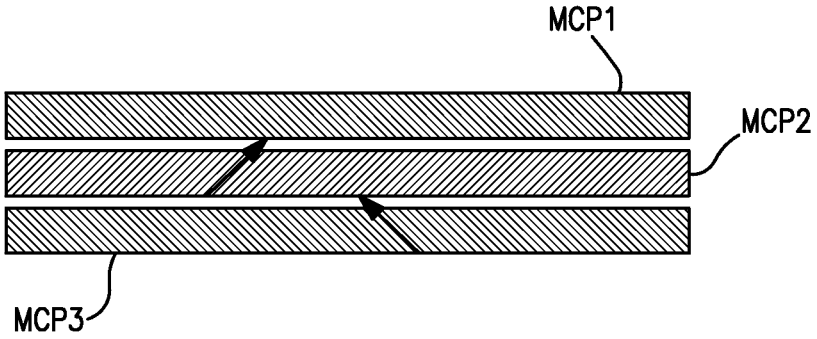
FIG. 4B (PRIOR ART)
FIG. 4B is a schematic view of three microchannel plates in the known Z-stack configuration.
Figure 5:
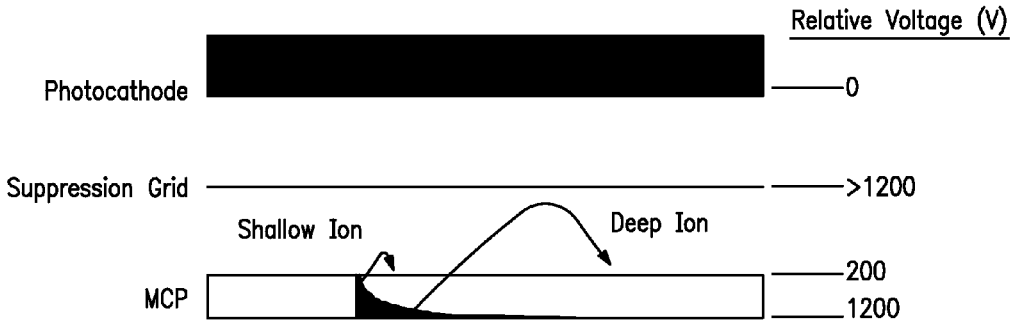
FIG. 5 is a schematic diagram showing the operation of a photomultiplier tube in accordance with the present invention.

The operation of a photomultiplier tube with a properly biased, ion suppression grid electrode located between the photocathode and input of the MCP in accordance with the present invention can effectively prevent positive ions from reaching the photocathode. The reduction of positive ion impingement on the photocathode effectively improves (increases) the life cycle of the photocathode. As illustrated in FIG. 5, when the ion suppression grid voltage exceeds the MCP output voltage substantially all positive ions are returned to the MCP where they are neutralized. If the voltage is maintained below that cutoff value, only those ions originating from the corresponding shallower (nearer to the input) regions of the MCP pores will be suppressed. The inventive concept can be extended to other variations, for example, an MCP-PMT that has a chevron MCP assembly or a Z-stack MCP assembly, so long as the suppression grid bias voltage can be energized above the maximum possible value for complete cutoff.

Working Example

In order to demonstrate the effectiveness of the photomultiplier (PMT) according to the present invention in suppressing ion feedback, a prototype device was constructed and tested as described below. The prototype device was constructed in accordance with the description presented in this specification and as shown in FIG. 7. The device included a bialkali photocathode deposited on a quartz window. A pair of microchannel plates with 25 micron diameter pores was arranged in a chevron configuration. A metallic anode was positioned adjacent the output surface of the microchannel plate stack and a conductive ion-suppression grid was located between the photocathode and the input surface of the microchannel plate stack. Testing was performed as follows to determine the operational effectiveness of the ion-suppression grid.

The window of the PMT was illuminated with a 35-picosecond width laser pulse that was filtered to single photoelectron intensity. The corresponding charge pulses were measured using a high-speed digitizing oscilloscope connected to the anode. On the occasion when a positive ion from the MCP stack was accelerated to the photocathode, electrons would be released from the photocathode resulting in an after-pulse that followed the primary photoelectron pulse in time. The total after-pulse occurrence rates were measured with the ion suppression grid energized at each of six different electric potentials starting at the same potential as the input of the MCP stack and increased in five increments up to the potential of the output surface of the MCP stack. Additionally, the late arrival time region containing large ion masses (i.e., ions having mass/charge>100 AMU) was separately analyzed and tabulated as such ions are presumed to be more damaging to the photocathode.

The results of the testing are shown in the table below including the electric potential of the ion suppression grid as a percentage of the electric potential at the Chevron MCP interface, the total raw after-pulsing rate in % per photoelectron, the total after-pulse rate normalized relative to the unsuppressed rate, the raw high mass after-pulsing rate in % per photoelectron, and the normalized high mass after-pulse rate. The Chevron MCP interface is defined as the plane where the upper and lower MCP's meet in the stacked arrangement.

| Suppression Grid Potential (% of Chevron Interface Potential) | Total Afterpulsing Rate (% per photo-electron) | Normalized Total After-pulse Rate | High Mass Afterpulsing Rate (% per photo-electron) | Normalized High Mass After-pulse Rate |
|---|---|---|---|---|
| 0 | 0.105 | 1.00 | 0.020 | 1.00 |
| 40 | 0.025 | 0.24 | 0.0096 | 0.47 |
| 80 | 0.017 | 0.16 | 0.0045 | 0.22 |
| 120 | 0.017 | 0.16 | 0.0037 | 0.18 |
| 160 | 0.018 | 0.17 | 0.0040 | 0.20 |
| 200 | 0.018 | 0.17 | 0.0045 | 0.22 |

The results reported in the table show a clear effect of the ion suppression grid in significantly reducing the rate of positive ions reaching the photocathode. The data show that ion suppression appears to level off when the suppression grid potential is about 80% or more of the Chevron MCP interface potential which verifies that ions are in fact originating deep in the MCP pores. The data represent a minimum expectation for ion feedback suppression because some of the after-pulses can be attributed to suppressed ions directly generating electrons by impinging on the input ends of the MCP pores. Another possible contribution of after-pulses may result from energetic neutral atoms or molecules that would not be affected by the suppression grid.

It will be recognized by those skilled in the art that changes or modifications may be made to the above-described embodiments without departing from the broad inventive concepts of the invention. It is understood, therefore, that the invention is not limited to the particular embodiments which are described, but is intended to cover all modifications and changes within the scope and spirit of the invention as described above and set forth in the appended claims.

The invention claimed is:

1. A photomultiplier tube comprising:

a photocathode having a first surface for receiving light and a second surface opposite the first surface from which electrons are emitted in response to light that is incident on the first surface;

an electron multiplying device positioned in spaced relation to said photocathode, said electron multiplying device having an electron receiving side that faces the second surface of said photocathode and an electron emission side opposite the electron receiving side, said electron multiplying device being positioned such that the electron receiving side is located at a preselected distance from the second surface of said photocathode;

a first electrode operatively connected to the electron receiving side of said electron multiplying device;

a second electrode operatively connected to the electron emission side of said electron multiplying device;

an ion suppression electrode positioned between said photocathode and said electron multiplying device and spaced therefrom, said ion suppression electrode comprising a grid that is configured to provide sufficient rigidity to avoid deformation during operation of the photomultiplier tube; and a source of electric potential connected to said second electrode and to said ion suppression electrode, said electric potential source being adapted to provide a first voltage to said second electrode and a second voltage to said suppression grid electrode wherein the second voltage has a magnitude equal to or greater than the magnitude of the first voltage.

2. The photomultiplier as claimed in claim 1 wherein said electron multiplying device comprises a microchannel plate.

3. The photomultiplier as claimed in claim 1 wherein the electron multiplying device comprises first and second microchannel plates arranged in stacked relation to each other.

4. The photomultiplier as claimed in claim 1 wherein said first electrode comprises a thin metal film formed on the electron receiving side and the second electrode comprises a second thin metal film formed on the electron emission side.

5. The photomultiplier as claimed in claim 1 wherein the grid comprises a first plurality of metal elements and a second plurality of metal elements interconnected with said first plurality of metal elements to form a plurality of openings framed by the interconnected first and second pluralities of metal elements, said plurality of openings having areas that are dimensioned to minimize potential gradients between the metal elements and to permit the passage of electrons through said grid.

6. The photomultiplier as claimed in claim 5 wherein adjacent ones of said first and second pluralities of metal elements are spaced from each other by a distance that is not greater than about one tenth of the preselected distance between the second surface of said photocathode and the electron receiving side of said electron multiplying device.

7. The photomultiplier as claimed in claim 1 comprising a charge collection anode positioned opposite to the electron emission side of said electron multiplying device.

8. The photomultiplier as claimed in claim 7 comprising a third electrode operatively connected to the second surface of said photocathode.

9. The photomultiplier as claimed in claim 1 wherein said photocathode, said electron multiplying device, said first and second electrodes, and said suppression electrode are rectangular in shape.

10. A method of making a photomultiplier comprising the steps of:

providing a photocathode having a first surface for receiving light and a second surface opposite the first surface from which electrons are emitted in response to light that is incident on the first surface;

providing an electron multiplying device in spaced relation from said photocathode, wherein said electron multiplying device has an electron receiving side that faces the second surface of said photocathode and an electron emission side opposing the electron receiving side, wherein said electron multiplying device is positioned such that the electron receiving side is located at a preselected distance from the second surface of said photocathode;

providing an ion suppression electrode between said photocathode and said electron multiplying device, said ion suppression electrode consisting of a fine mesh grid;

energizing the electron receiving surface of the electron multiplying device with a first voltage;

energizing the electron emission surface of the electron multiplying device with a second voltage that is greater in magnitude than the first voltage; and energizing the suppression electrode with a third voltage having a magnitude that is equal to or greater than the magnitude of the second voltage.

11. The method claimed in claim 10 wherein the step of providing the ion suppression electrode comprises the step of forming the fine mesh grid by providing a first plurality of metal elements and a second plurality of metal elements intertwined with said first plurality of metal elements to form a plurality of openings framed by the intertwined first and second pluralities of metal elements, said plurality of openings having areas that are dimensioned to minimize a potential gradient between the metal elements and to permit the passage of electrons through said grid.

12. The method claimed in claim 11 wherein the step of forming the fine mesh grid comprises the step of spacing adjacent ones of said first and second pluralities of metal elements from each other by a distance that is not greater than about one tenth of the preselected distance between the second surface of said photocathode and the electron receiving side of said electron multiplying device.

13. The method claimed in claim 10 comprising the step of a providing a charge collection anode that is positioned opposite to the electron emission side of said electron multiplying device.

14. The method claimed in claim 13 comprising the step of connecting a third electrode to the second surface of said photocathode.

15. The method claimed in claim 10 wherein said photocathode, said electron multiplying device, said first and second electrodes, and said suppression electrode are provided in rectangular shapes.

* * * * *